US005442944A

United States Patent [19]

Lu

[11] Patent Number: 5,442,944

[45] Date of Patent: Aug. 22, 1995

[54] AUTO-FEED CONTROL MECHANISM FOR COMPUTERIZED NUMERICALLY-CONTROLLED SPRING FORMING MACHINE

[75] Inventor: Chin-Pang Lu, Taipei Hsien, Taiwan

[73] Assignee: Hertong Machinery Ent. Co., Ltd., Taipei Hsien, Taiwan

[21] Appl. No.: 226,031

[22] Filed: Apr. 11, 1994

[51] Int. Cl.[6] ..... B21F 3/10; B21F 35/02

[52] U.S. Cl. ..... 72/138; 72/137

[58] Field of Search ..... 72/135, 138, 168, 307, 72/137; 140/105, 71, 71 R

[56] References Cited

U.S. PATENT DOCUMENTS

| | | | |
|---|---|---|---|
| 3,393,714 | 7/1968 | Ott | 140/71 |
| 3,493,016 | 2/1970 | Ott | 140/71 R |
| 3,734,146 | 5/1973 | Nazyrov et al. | 140/71 R |
| 3,908,433 | 9/1975 | Helzer | 72/388 |
| 4,799,373 | 1/1989 | Benton | 72/307 |

*Primary Examiner*—Lowell A. Larson
*Assistant Examiner*—Rodney A. Butler
*Attorney, Agent, or Firm*—Varndell Legal Group

[57] ABSTRACT

Disclosed is an auto-feed control mechanism for computerized numerically-controlled spring-forming machines. A gooseneck tool handle is fixedly connected at a middle point to a movable supporting arm and pivotly connected at a rear end to a fixing member, such that the movable supporting arm can be driven by a third motor to downwardly incline the tool handle relative to the fixing member. The fixing member is fixed to a tool-rotating disk which can be driven to rotate by a second motor so that the tool handle fixed thereto can be universally rotated. A first motor has a rotary shaft connected at one outer end to a threaded rotary shaft. The threaded rotary shaft passes through and engages with a threaded ring provided at a side wall of a tool holder such that when the first motor rotates, the threaded rotary shaft is driven to rotate inside the threaded ring and thereby causes the tool holder to move forward or backwarad. With these arrangements, one single tool bit can be used by the auto-feed control mechanism to complete the forming of a spring conveniently at reduced cost.

1 Claim, 7 Drawing Sheets

AUTO-FEED CONTROL MECHANISM FOR COMPUTERIZED NUMERICALLY-CONTROLLED SPRING FORMING MACHINE

BACKGROUND OF THE INVENTION

The present invention relates to an auto-feed control mechanism for computerized numerically-controlled (CNC) spring forming machines, in which a tool handle is mounted in front of the spring forming machine near a steel wire feeding end thereof and can be driven by motors to move forward or backward, and to rotate and/or incline and be positioned at any desired angle, so that a tool connected to the tool handle can be more actively manipulated to bend a steel wire to form various kinds of irregularly-shaped springs at reduced cost and in higher efficiency.

In a conventional manner of forming a spring, a spring forming machine having an automatic wire feeding mechanism is used together with a multi-jaw tool feeding mechanism attached to the front of the spring forming machine, so that the tool feeding mechanism shall moves the tool to form the fed steel wire at a point near the wire-feeding end of the spring forming machine and thereby automatically bends or deforms the steel wire to form a spring with a desired shape.

In the above mentioned multi-jaw tool feeding mechanism, the linear feeding of tools is not active enough for the present spring forming process, because the spring itself usually has different winding and bending angles while the tools are fed at an equal circumferential angle within a plane normal to the feeding direction of the wire. When the wire is continuously fed, the tool feeding mechanism on each jaw timely extends one by one under the control of a CNC program controlled system, such that two tools separately support and press the wire and respectively function as a fulcrum and an upper application point, forcing the spring steel wire to automatically wind to form the desired shape.

The disadvantages existed in the conventional multi-jaw tool feeding mechanism further include:

1. Each tool handle of the multi-jaw tool feeding mechanism is individually extended to wind and bend the steel wire during the forming of spring. Due to this individual movement of each tool handle, the tool feeding mechanism has a very complicated structure with numerous parts and components and, therefore, accounts for a very high manufacture cost of the conventional spring forming machine.
2. Since each of the tools mounted on the movable jaws of the spring forming machine is linearly fed at an equal circumferential angle, differently shaped tools are required to form springs with special shapes. Such specially shaped tools are usually manually ground and formed by skilled workers which is extremely time and labor consuming.
3. Since each of the tool handles is mounted on the front panel of the spring forming machine, the tools are fed in a direction normal to the direction in which the wire is fed. Therefore, dead angles exist when the wire is bent, and springs with more complicate bending angles are be very difficult to form.
4. Since the tools can only be fed in the same plane, two tools are required to separately function as a fulcrum and an application point to wind a steel wire. After the wire is bent and formed in this way, cracks are frequently found on the wire surface at fulcrums thereof due to focused stress.

It is therefore the present inventor has developed an auto-feed control mechanism for the CNC spring-forming machine that eliminates the above mentioned disadvantages.

SUMMARY OF THE INVENTION

A primary object of the present invention is therefore to provide an auto-feed control mechanism for CNC spring forming machines, mounted in front of the wire feeding end of the spring-forming machine, in which only one single tool handle is required to automatically move, rotate, and incline the tool, permitting the same to bend the steel wire in all circumferential angles and thereby form a spring with any desired shape.

A second object of the present invention is to provide the above auto-feed control mechanism for CNC spring forming machines in which the structure is simplified with easily manufacturable parts and components and therefore largely reduces the manufacture cost of the spring forming machine.

A further object of the present invention is to provide the above auto-feed control mechanism for CNC spring forming machines, in which the wire is bent by the rotary tool in two steps and thereby focused stress on any fulcrum as shown in the conventional spring-forming manner can be avoided to prevent the spring from breaking due to inferior tensile strength of the wire.

A still further object of the present invention is to provide the above auto-feed control mechanism for CNC spring forming machines, in which only one single universally rotatable tool is required. No other tools with manually ground shapes are needed and the working efficiency is therefore largely improved.

A still further object of the present invention is to provide the above auto-feed control mechanism for CNC spring forming machines, in which the tool feeding can be more easily controlled by CNC programs.

The auto-feed control mechanism according to the present invention mainly comprises a tool-moving mechanism, a tool-rotating mechanism, a tool-inclining mechanism, and a tool holder.

The tool-moving mechanism comprises a first driving motor having a first central rotary shaft which connects at one outer end with a threaded guide rod passing through a threaded ring provided at one side wall of the tool holder, such that when the threaded guide rod is driven by the first driving motor via the first central rotary shaft to rotate inside the threaded ring, the tool holder is brought to move forward or backward.

The tool-rotating mechanism comprises a second driving motor having a second central rotary shaft to which a fourth rotary shaft is connected; the fourth rotary shaft has a first pinion fixed to an outer end thereof to mesh with a first bull gear which is distantly connected to a tool-rotating disk by means of pins; the tool-rotating disk has a central through hole and an outward projected fixing member for pivotly receiving a rear end of a tool handle therein. When the tool-rotating disk is driven to rotate by the second motor via the first pinion and the first bull gear, a tool connected to the tool handle fixed to the fixing member on the tool-rotating disk also rotates.

The tool-inclining mechanism comprises a third driving motor having a third central rotary shaft, to an upper end of which a second pinion is fixed to mesh with a second bull gear fixed to a lower end of a positioning shaft. The positioning shaft connects at an upper end a guide wheel with circumferentially formed grooves which mesh with a rack disposed adjoining the guide wheel. The rack connects at one end opposite to the guide wheel a rotary connection which in turn connects a tool supporting arm, allowing the latter to extend through the through hole of the tool-rotating disk and be fixed to the tool rear handle at a properly predetermined point such that when the rack is driven to move forward or backward by the third driving motor through the second pinion, the second bull gear, and the guide wheel, the tool supporting arm brings the tool rear handle to incline downward relative to the fixing member to which the tool rear handle is pivotly fixed.

BRIEF DESCRIPTION OF THE DRAWINGS

The structure, features, and functions of the present invention can be best understood through the following detailed description of the preferred embodiment and the accompanying drawings, wherein.

DETAILED DESCRIPTION OF THE PREFERRED EMBODIMENT

Figure 1:
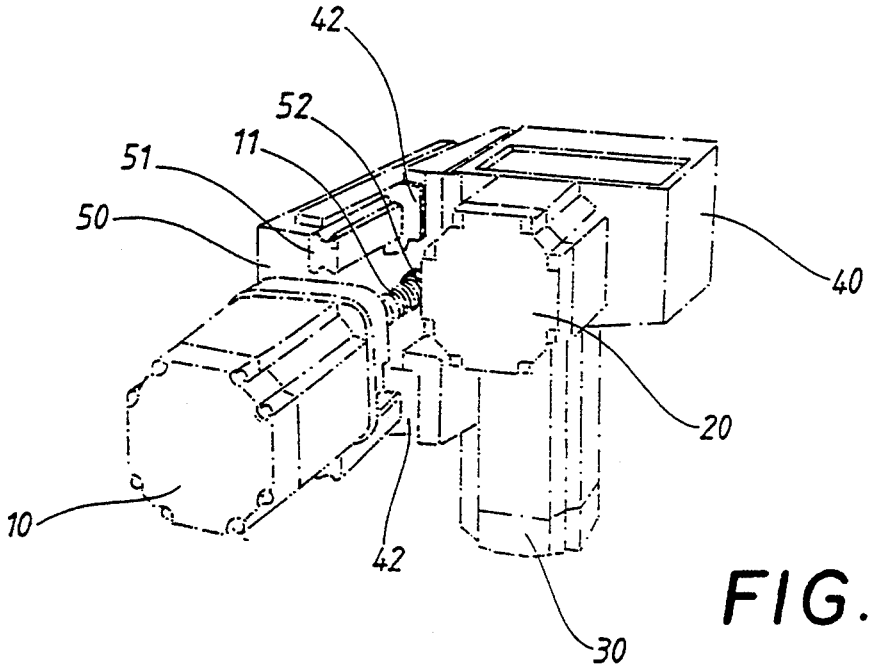
FIG. 1 is a schematic perspective of the present invention.
Figure 2:
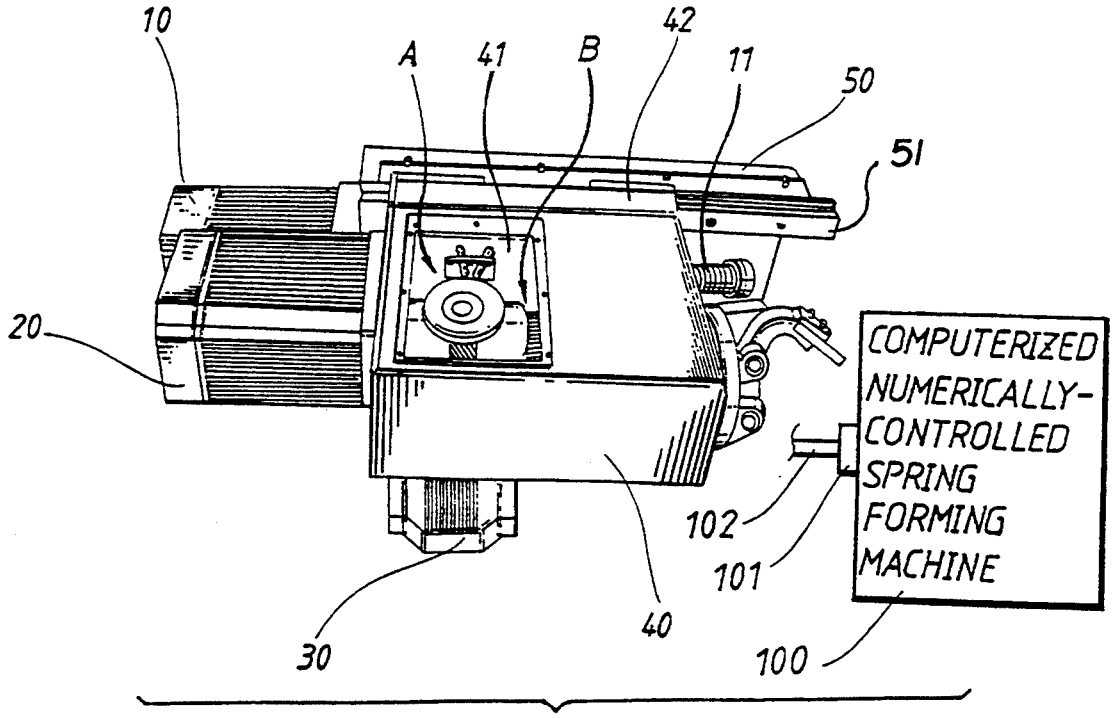
FIG. 2 is a perspective side view of the present invention; together with a CNC spring forming machine.

Please refer to FIGS. 1 and 2. The present invention is an auto-feed control mechanism for a computerized numerically-controlled (CNC) spring forming machine and mainly comprises a tool-holder driving motor 10, a tool-rotating driving motor 20, a tool-inclining driving motor 30, and a tool holder 40.

The tool holder 40 has an accessible hollow chamber 41 inside which a tool-rotating mechanism A and a tool-inclining mechanism B are mounted. An upper and a lower horizontally parallelled dovetail grooves 42 are provided at one outer side of the tool holder 40 to serve as sliding guides such that the two dovetail grooves 42 separately engage with a guide rail 51 fixed on a machine seat 50 adjoining the tool holder 40. An internally threaded ring 52 is provided on the same side wall of the tool holder 40 between the two dovetail grooves 42 for a threaded guide rod 11 of the tool-holder driving motor 10 to thread therethrough.

The tool-holder driving motor 10 is used to control the forward and backward sliding of the tool holder 40. The threaded guide rod 11 is connected to a central shaft of the motor 40 at one end thereof and passes through the threaded ring 52 provided at one side of the tool holder 40, permitting the tool-holder driving motor 10 to drive the tool holder 40 to slidably move forward or backward.

Figure 3:
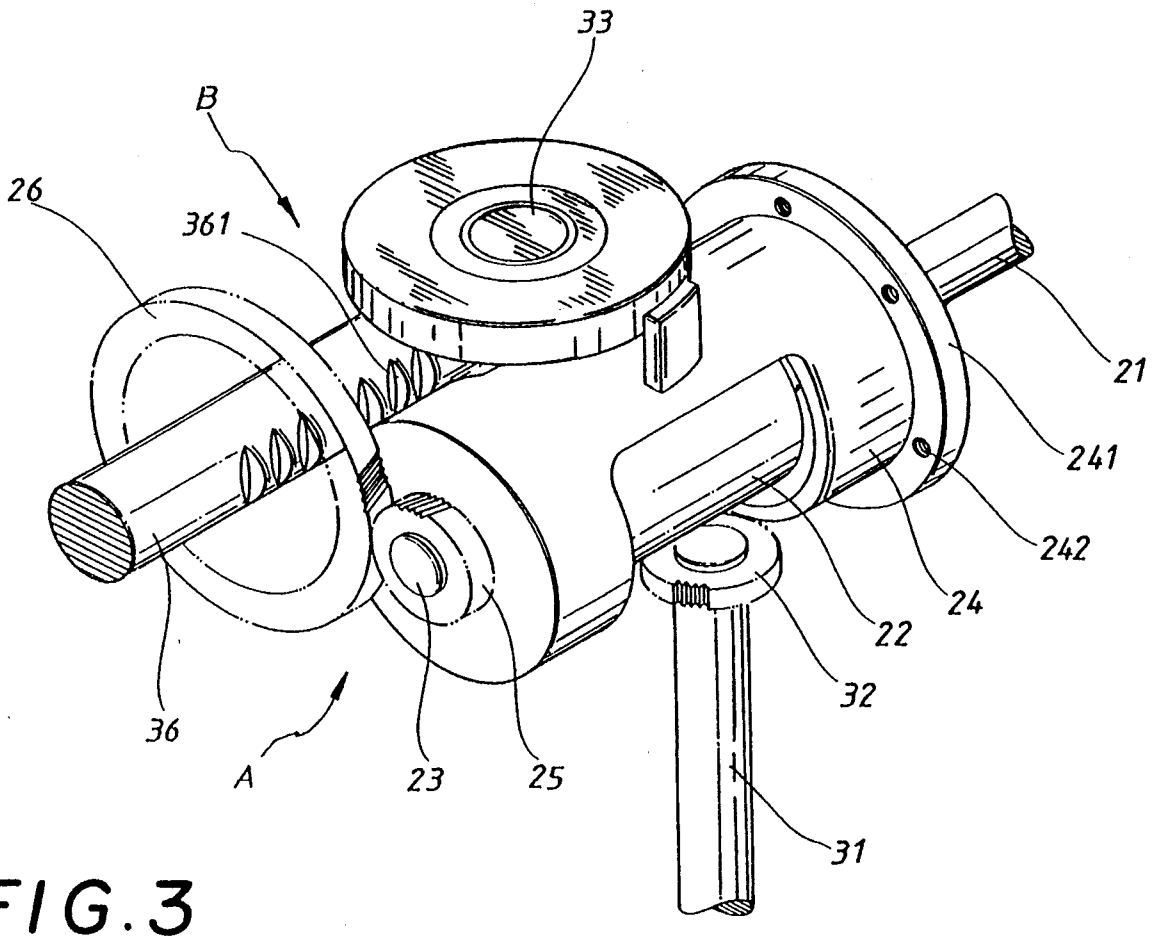
FIG. 3 illustrates the transmission mechanisms inside the present invention.
Figure 4A:
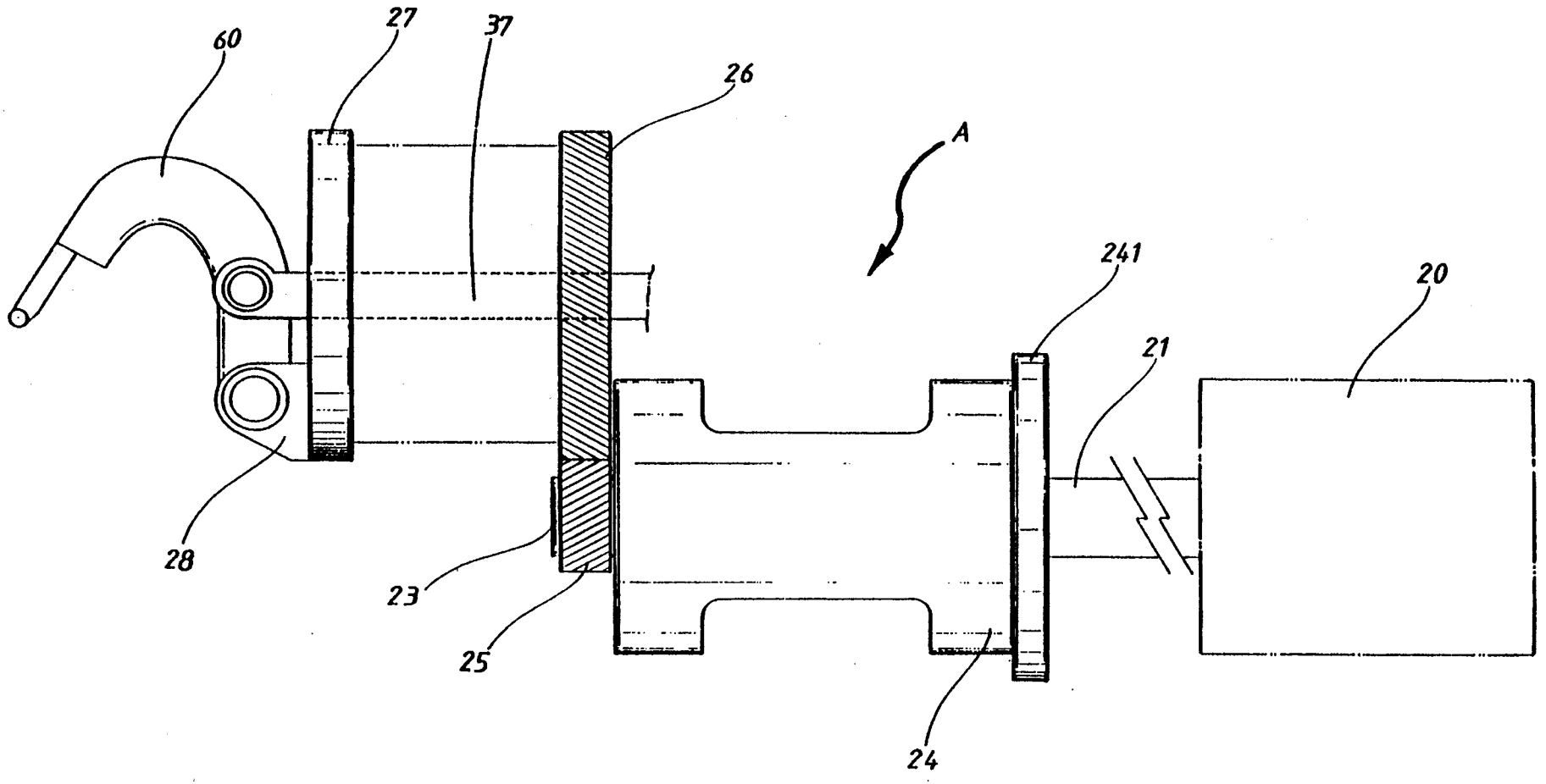
FIG. 4A illustrates the tool rotating mechanism of the present invention.
Figure 4B:
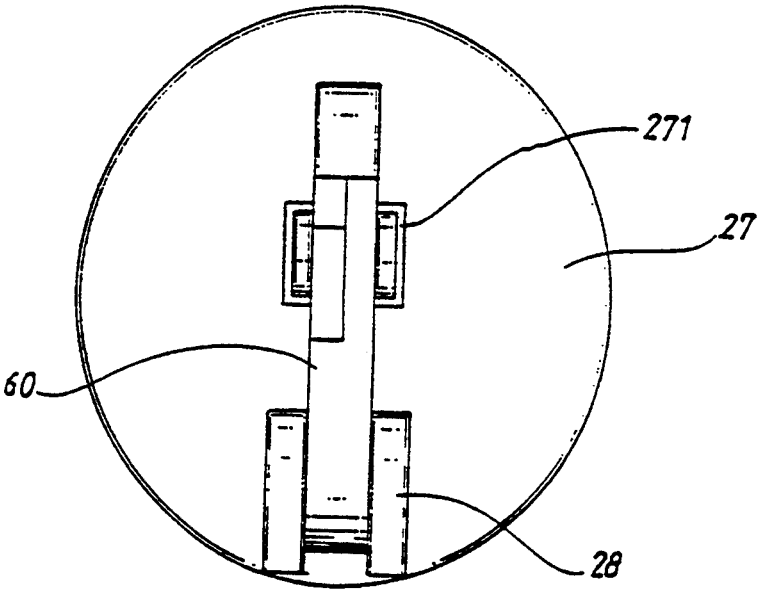
FIG. 4B is a front view of the tool-rotating disk of the tool-rotating mechanism shown in FIG. 4A.
Figure 6:
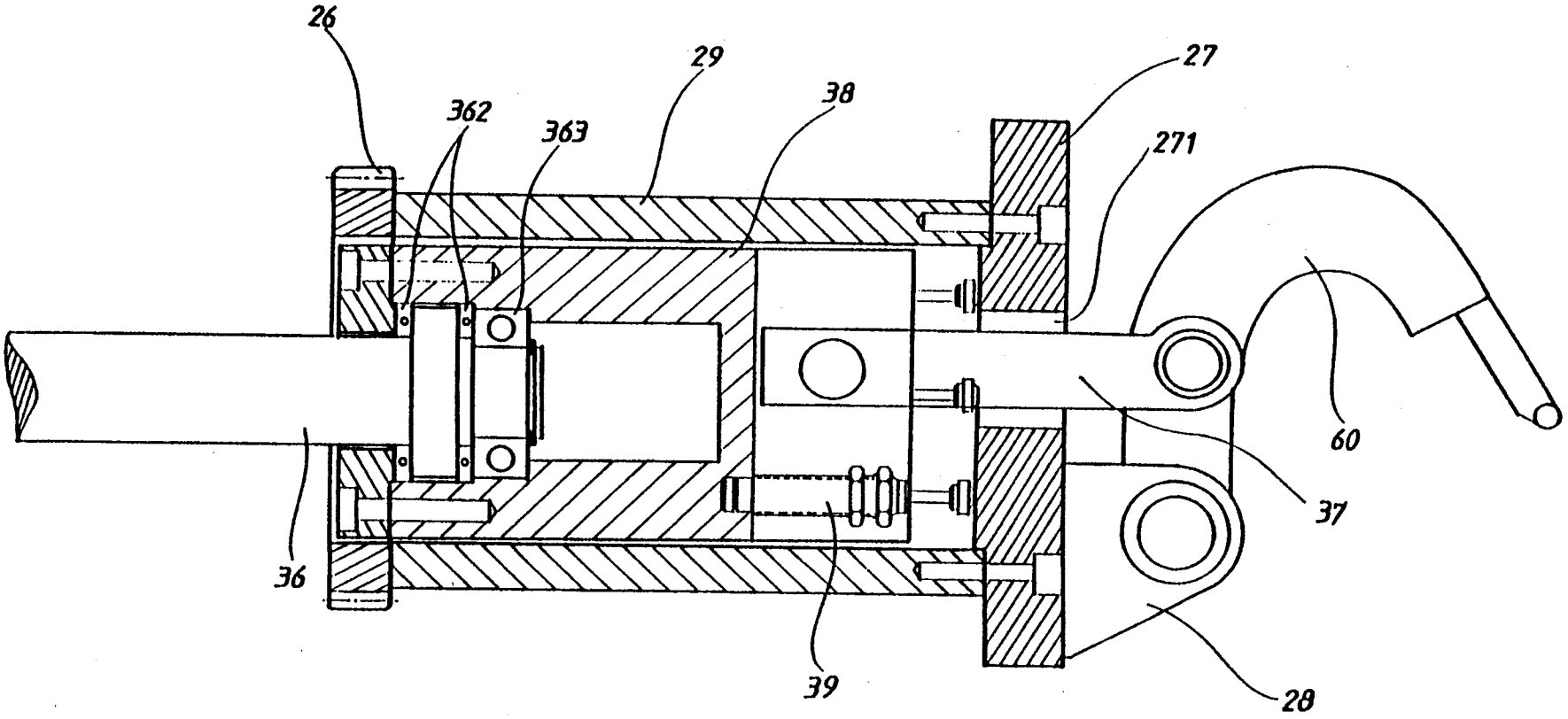
FIG. 6 is a fragmentary side sectional view showing the relation of the rack to the tool-rotating disk of the present invention.

Please refer to FIGS. 3 and 4A. The tool-rotating mechanism A mainly consists of the tool-rotating driving motor 20 of which a central rotary shaft 21 extends into the hollow chamber 41 of the tool holder 40. Another rotary shaft 23 is connected to the central rotary shaft 21 via a shaft bushing 22, such that when the driving motor 20 rotates, the central rotary shaft 21 and, accordingly, the rotary shaft 23 is driven to rotate which further rotates a pinion 25 attached to one end of the rotary shaft 23 opposite to the central rotary shaft 21. A fixing sleeve 24 having a flanged fixing seat 241 at one end thereof is used to house the rotary shafts 21, 23 and the shaft bushing 22. There are a plurality of screw holes 242 spaced on the flanged fixing seat 241 so that the fixing sleeve 24 can be fixedly attached to the hollow chamber 41 of the tool holder 40 by means of screws threading through the screw holes 242. Bearings are separately provided at each end of the fixing sleeve 24 so that the central rotary shaft 21 of the motor 20 and the rotary shaft 23 are rotatable relative to the fixing sleeve 24. The pinion 25 is rotatably attached to the free front end of the rotary shaft 23 to engage with and thereby drive a bull gear 26 distantly connected to a tool-rotating disk 27 by means of pins, as shown in FIG. 6. The tool-rotating disk 27 is located outside the hollow chamber 41 of the tool holder 40 and will be further described below.

Figure 4C:
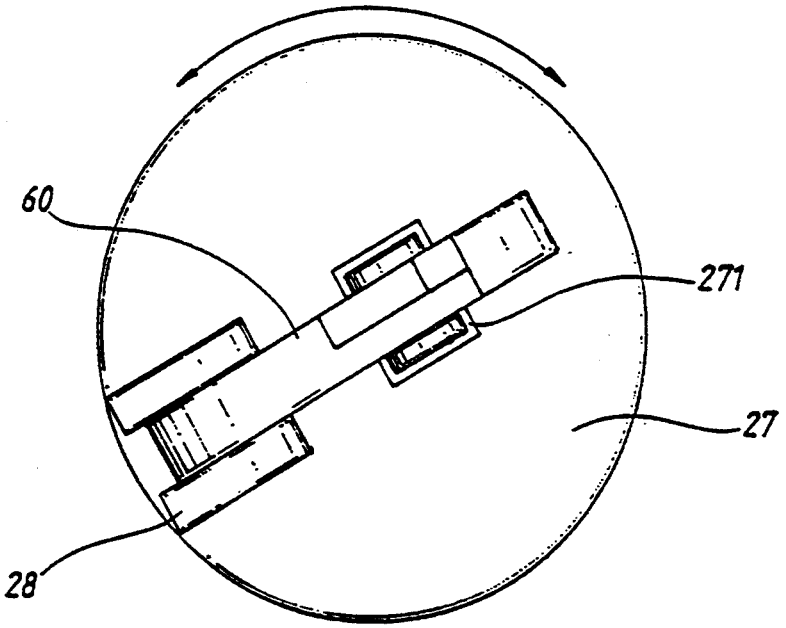
FIG. 4C is a view similar to FIG. 4B , with the tool handle being rotated to a certain angle during working process.

Please refer to FIGS. 4A, 4B, 4C, and 6. The tool-rotating disk 27 has a central through hole 271 and an axially outward projected fixing member 28 for pivotly receiving a rear handle 60 of a tool bit thereon. As shown in FIG. 6, a shaft bushing 29 connects the tool-rotating disk 27 and the bull gear 26 by means of pins. When the bull gear 26 is driven to rotate, the tool-rotating disk 27 distantly connected to the bull gear 26 also rotates. The tool bit being fixed on the fixing member 28 shall, therefore, be turned along with the tool-rotating disk 27, as shown in FIG. 4C.

Figure 5A:
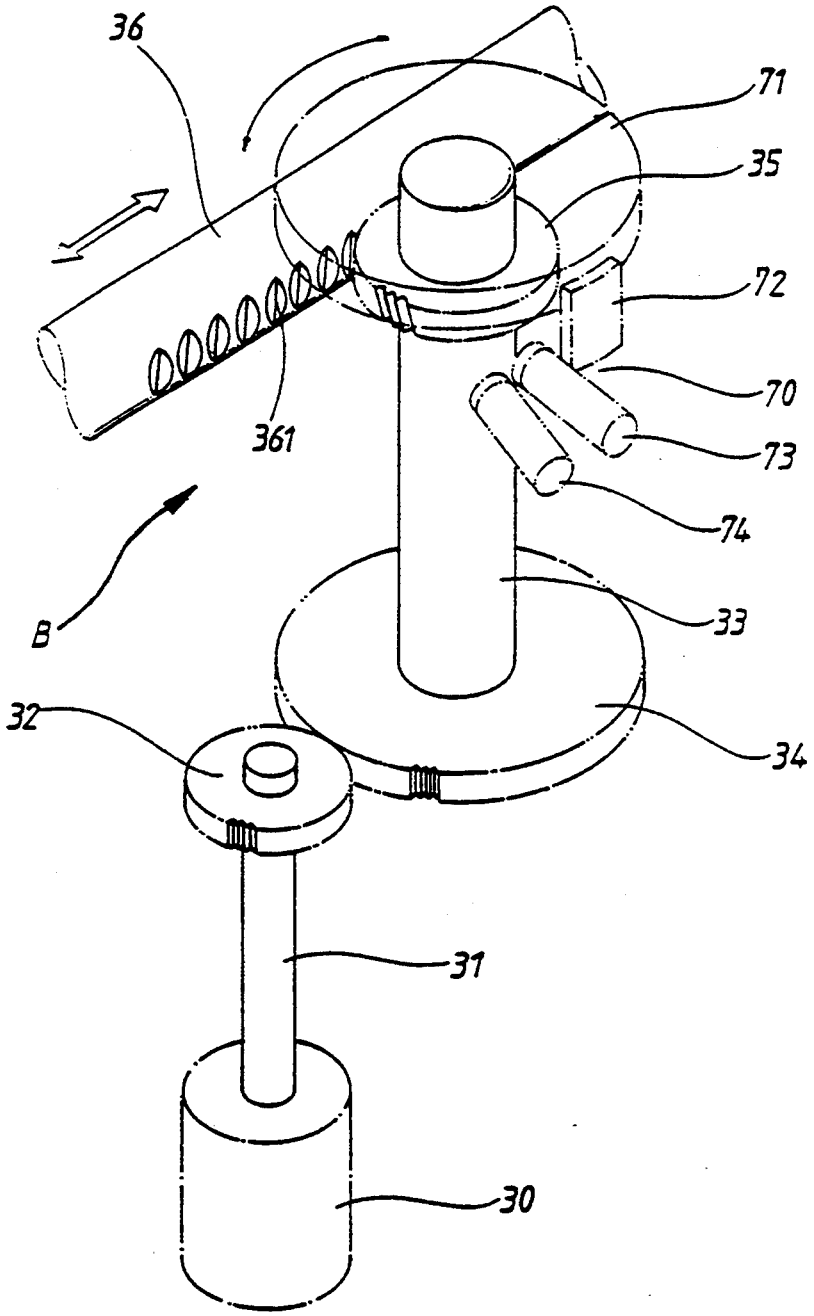
FIG. 5A illustrates the tool-inclining mechanism of the present invention.

Please refer to FIGS. 3 and 5A. The tool-inclining mechanism B of the present invention mainly consists of the tool inclining driving motor 30. A central rotary shaft 31 of the motor 30 vertically extends upward into the hollow chamber 41 of the tool holder 40 and has a pinion 32 provided at its top end to engage with a bull gear 34 fixedly connected to one lower end of a positioning shaft 33. When the motor 30 rotates, the pinion 32 and the bull gear 34, accordingly, are driven to rotate. At this point, a guide wheel 35 fixedly connected to an upper end of the positioning shaft 33 is driven to rotate due to the engagement of the pinion 32 with the bull gear 34. A rack 36 with a plurality of grooves 361 is fixed next to the guide wheel 35 by means of pins such that the grooves 361 of the rack 36 engage into grooves formed on a circumferential periphery of the guide wheel 35. By this arrangement, the rotating force generated by the motor 30 can be transferred to the rack 36 and causes the same to move forward or backward.

Figure 5B:
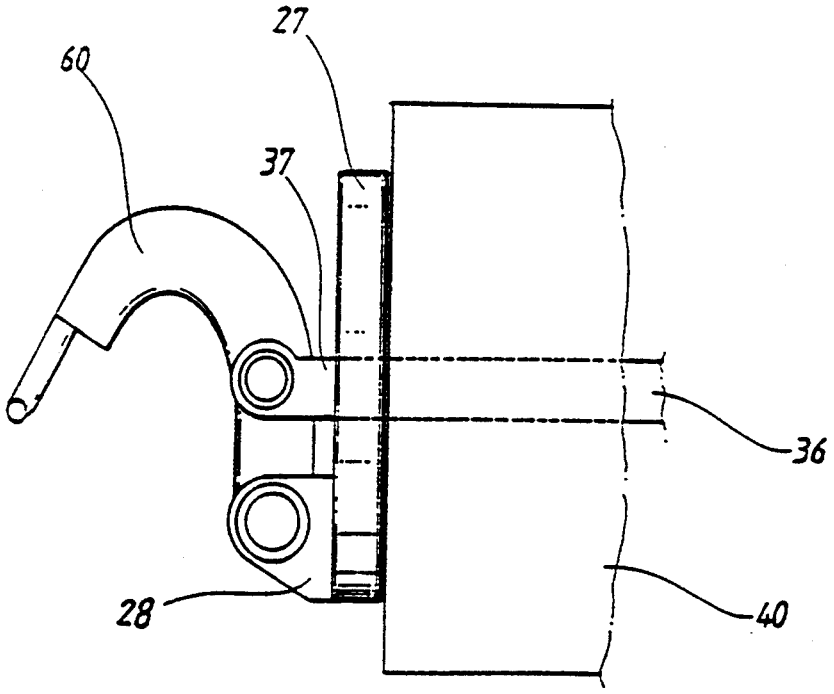
FIG. 5B is a fragmentary side view with the tool handle locating at a normal position.
Figure 5C:
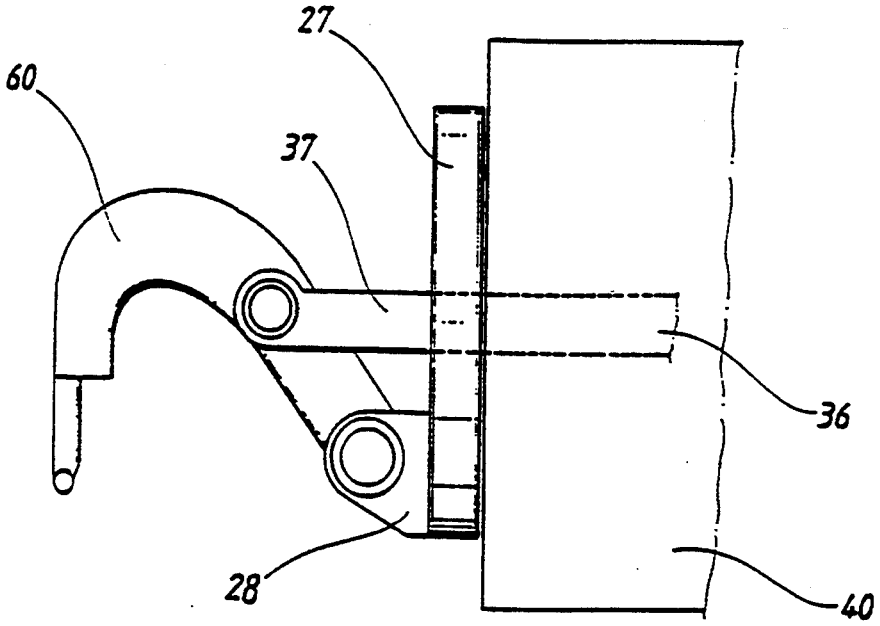
FIG. 5C is a view similar to FIG. 5B with the tool handle locating at an "inclined" position.

Please refer to FIGS. 5B, 5C, and 6. One front end of the rack 36 is connected to a movable tool support arm 37 at one end thereof. The other end of the movable tool support arm 37 extends through the through hole 271 of the tool rotating disk 27 to be securely fixed to a substantially middle point of the tool rear handle 60.

When the rack 36 is brought to move forward or backward, the movable tool support arm 37 is also pushed forward or pulled backward, respectively. Since one rear end of the tool rear handle 60 is pivotly received in the fixing member 28 of the tool rotating disk 27, the tool rear handle 60 is forced to pivotly incline downward relative to the fixing member 28 when the tool support arm 37 is pushed forward. At this point, the tool with its rear handle 60 fixed to the fixing member 28 shall be arranged at a point close to the steel wire for forming a spring. See, for example, FIG. 2 where 100 is the CNC spring forming machine, 101 is the wire-feeding end thereof and 102 is the fed wire.

Please refer to FIG. 6, a transmission piston assembly is disposed between the rack 36 and the tool rotating disk 27, mainly including a rotary connection 38. The rack 36 is connected to one end of the rotary connection 38 by means of two thrust bearings 362 and a bearing 363. One end of the tool support arm 37 is fixed to the other end of the rotary connection 38 opposite to the rack 36. The other end of the tool support arm 37 extends through the through hole 271 of the tool-rotating disk 27 and connects the tool rear handle 60. Three pieces of oil pressure cylinders 39 are disposed inside the rotary connection 38 between the latter and the tool-rotating disk 27 for automatically adjusting the clearance between the rotary connection 38 and the tool-rotating disk 27, such that when the tool-rotating disk 27 rotates, the rack 36 moves forward or backward, accordingly.

Please refer back to FIGS. 3 and 5A. A travel limiting mechanism 70 is provided to limit the forward and backward travels of the rack 36. The travel limiting mechanism 70 includes a rotary disk 71 fixedly connected over the guide wheel 35, a stopper 72 fixed to a properly predetermined position on a circumferential periphery of the rotary disk 71, and two limit switches 73, 74 separately arranged in the circumferential travel of the stopper 72. When the guide wheel 35 is brought to rotate clockwise or counterclockwise and brings the rack 36 to move forward or backward, respectively, the rotation of the rotary disk 71 caused by the guide wheel 35 to which the rotary disk 71 is fixed shall be limited in either direction by the contact of the stopper 72 with the limit switches 73, 74. That is, the limit switches 73, 74 are actuated to limit the rack 36 to travel within a safe range.

According to the above arrangement, it can be seen that the auto-feed control mechanism for a CNC spring-forming machine provided by the present invention is much more simplified in the structure, and therefore, can be easily manufactured at reduced cost than the conventional spring forming machines. Moreover, only one single tool bit is required to process the steel wire for forming the spring because the tool bit is universally rotatable. Thereby, the working efficiency is highly enhanced and the bothersome procedures for manually grinding the forming tool bit can be saved which largely shortens the time required to produce the spring and the CNC programs for controlling the feeding of the tool bit can be more conveniently designed. In brief, the present invention is very practical in use.

What is claimed is:

1. An auto-feed control mechanism for a computerized numerically-controlled spring forming machine arranged in front of said spring forming machine near a wire-feeding end thereof such that a tool bit connected to said auto-feed control mechanism is maneuvered in any desired direction or at any desired angle to form a spring; said auto-feed control mechanism comprising a tool holder, a tool-moving mechanism, a tool-rotating mechanism, and a tool-inclining mechanism;

said tool holder having a threaded ring and a rear handle for holding said tool bit, said tool-moving mechanism having a first driving motor with a first central rotary shaft, said first central rotary shaft having an end with a threaded guide rod passing through said threaded ring of said tool holder, such that when said threaded guide rod is rotated by said first driving motor through said first central rotary shaft, said tool holder moves forward or backward through rotational engagement of said threaded guide rod and said threaded ring, said tool-rotating mechanism having a second driving motor with a second central rotary shaft, a fourth rotary shaft rotated by said second central rotary shaft, a first pinion connected to an end of said fourth rotary shaft, a first bull gear meshing with said first pinion, a tool-rotating disk connected to said first bull gear by means of pins; said tool-rotating disk having a central through hole and an outward projected fixing member pivotally attached to said rear handle of said tool holder, and said tool-inclining mechanism having a third driving motor with a third central rotary shaft, said third central rotary shaft having an upper end with a second pinion; said second pinion meshing with a second bull gear, a positioning shaft having a lower end connected to said second bull gear; said positioning shaft having an upper end connected to a guide wheel, said guide wheel having circumferentially formed grooves, a rack arranged adjacent said guide wheel, said rack having one end with grooves engaging said circumferentially formed grooves of said guide wheel and another end rotatably connected to a tool supporting arm, said tool supporting arm extending through said through central hole of said tool-rotating disk and having an end pivotally fixed to said tool rear handle at a location such that when said rack is moved forward or backward by said third driving motor through said second pinion, said second bull gear and said guide wheel, said tool supporting arm inclines said tool rear handle downward or upward relative to said fixing member.

* * * * *